United States Patent [19]

Borroni

[11] 4,118,593

[45] Oct. 3, 1978

[54] PROCESS FOR MANUFACTURING MULTI-CORE ELECTRIC POWER CABLES AND CABLES SO-PRODUCED

[75] Inventor: Andrea Borroni, Carimate (Como), Italy

[73] Assignee: Industrie Pirelli Societa per Azioni, Milan, Italy

[21] Appl. No.: 744,609

[22] Filed: Nov. 24, 1976

[30] Foreign Application Priority Data

Dec. 5, 1975 [IT] Italy ..... 30001 A/75

[51] Int. Cl.[2] ..... H01B 9/06

[52] U.S. Cl. ..... 174/26 R; 29/624; 156/56

[58] Field of Search ..... 174/25 R, 15 C, 27, 174/26, 116, 113 R, 103; 29/624; 156/47, 52, 53, 54, 55, 56

[56] References Cited

U.S. PATENT DOCUMENTS

| | | | |
|---|---|---|---|
| 2,050,990 | 8/1936 | Atkinson | 174/107 X |
| 2,479,924 | 8/1949 | Gillis | 174/107 X |
| 3,197,553 | 7/1965 | Nicolas | 174/107 |
| 3,459,871 | 8/1969 | Eager, Jr. et al. | 174/25 R |
| 3,749,812 | 7/1973 | Reynolds et al. | 174/25 R |

*Primary Examiner*—Arthur T. Grimley

*Attorney, Agent, or Firm*—Brooks, Haidt, Haffner & Delahunty

[57] ABSTRACT

A process for making a multi-core, fluid impregnated, electric, submarine cable of long length in which each core is separately formed, impregnated and sheathed before the so-formed units are combined within an armor layer which is covered by a bituminous material. Each unit is formed by forming a conductor of long length having an oil conduit therein. The conductor is covered by paper tape insulation layers, conductive screening layers optionally being applied before and after the covering of the conductor by the paper tape. The so-formed core is then vacuum treated and impregnated with insulating oil, covered with a fluid impermeable sheath which is then protected by blindage of metal tape. Over the blindage, a plastics sheath is formed, and the so-formed unit is combined with similar units which are covered by the armor layer of metal and the layer of bituminous material. The spaces between units and between the units and the armor layer may be filled with a filler material. Also, a cable produced by such process.

16 Claims, 2 Drawing Figures

Figure 1:
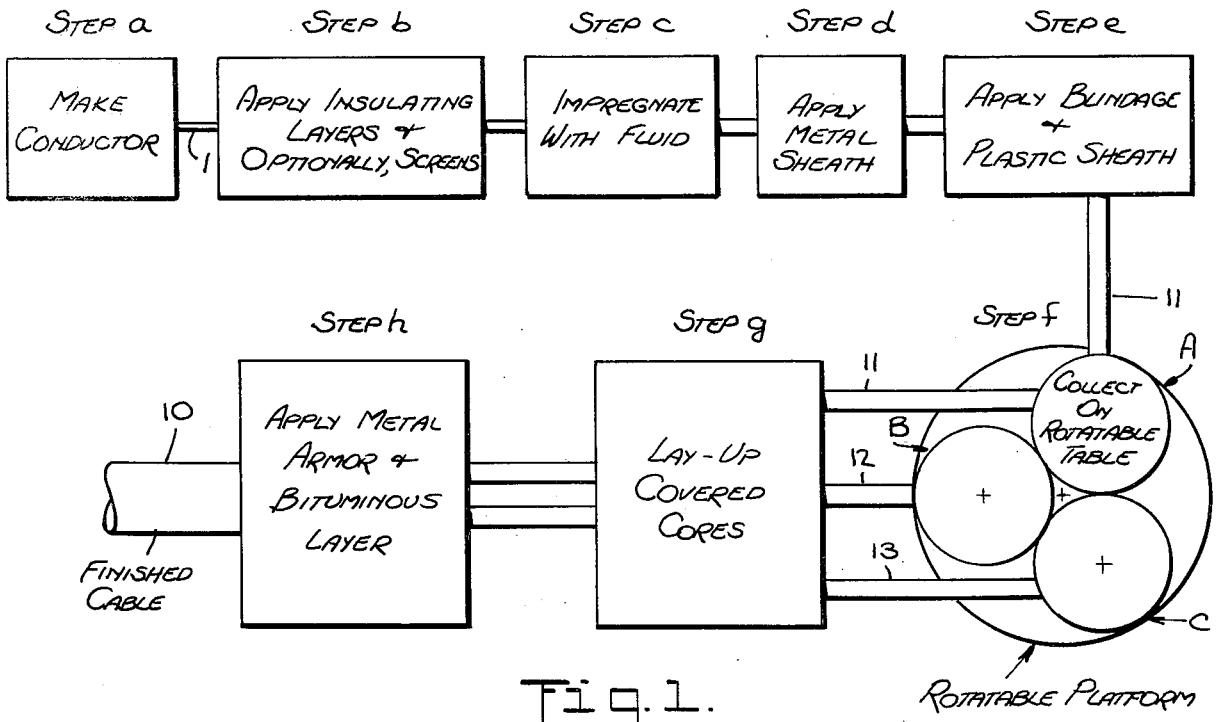

PROCESS FOR MANUFACTURING MULTI-CORE ELECTRIC POWER CABLES AND CABLES SO-PRODUCED

The present invention relates to a process for producing multi-core power cables for conveying high-tension electrical energy, which are of the type wherein the insulation for the conductor is composed of a series of spirally wound tapes which are impregnated with a suitable impregnating fluid. In particular, this invention relates to submarine cables which are to be constructed in relatively long lengths, e.g., a length of several kilometers.

It is to be noted that in cables of this type, the uninterrupted length is of great importance because it is correspondingly possible to reduce the number of joints in an installation, thereby limiting any possible defects arising from the use of these joints.

Different known processes exist for making long lengths of oil-filled, multi-core cables. Among those processes which may be mentioned is the one described in the Italian Patent No. 801,543, which process, summarized briefly, comprises the following steps:

(a) making each conductor separately;
(b) applying the insulating layer on the conductor so as to form a core;
(c) collecting three cores on three auxiliary platforms, each of which rotates on its own vertical axis, and all of which are supported by a main platform which also rotates on its own vertical axis;
(d) lifting such three cores from said auxiliary platforms, and laying-up the three cores without torsioning them;
(e) collecting the three layed-up cores and arranging them inside an impregnation tank;
(f) proceeding with the impregnation of the three cores with an insulating fluid, after previously suitably drying and evacuating them; and thereafter,
(g) sealing said three cores by applying a single lead sheath (this lead sheath may be replaced by a corrugated aluminum sheath).

The process described in the patent also comprises other steps for applying over said lead sheath other protective coverings, for example, a blindage formed by metallic tapes, for the purpose of providing an adequate resistance against stresses in the radial direction of the cable, an armoring, intended to provide an adequate resistance against tensile stresses in the axial direction of the cable and a sheath of bituminous material, for preventing sea-water corrosion.

Italian Patent No. 801,543 also describes a plant for effectuating this process, but it is not necessary to describe said plant at this point, since the present invention relates to an improved process, which can be carried out either with said plant or with other plants.

By employing the process and the plant described in said patent, long length cables may be obtained, e.g., a length of several kilometers, and therefore, satisfactory cable lengths are obtainable. However, it must be noted that, the steps of this process which are intermediate the application of the insulating layers around the conductor and the fluid-oil impregnation of these layers, are particularly "delicate" operations as it is necessary to prevent ambient humidity from being absorbed by the insulating layers (generally, paper-layers) which could compromise the quality of the cable.

For this purpose, certain procedures are adopted, for example, the step of lapping the insulating paper-layers inside a conditioned ambient (with, for example, an ambient humidity between 5% and 10%) to minimize the absorption of moisture by the layers.

It should be noted, however, that in producing multi-core cables according to the process described hereinbefore, the steps which have been defined as "delicate" are rather numerous, i.e., comparatively more numerous than the steps needed for constructing a single-core cable which does not include the step of laying-up a plurality of cores. Because of the lengths of the cores, the laying-up step would generally be executed outside the conditioned ambient. For this reason, the possibility of absorbing ambient humidity during construction is greater with a multi-core cable than with a single-core cable.

Hypothetically speaking, an appropriate conditioned ambient could be employed for all the steps defined hereinbefore as "delicate" (i.e., the steps intermediate the application of the insulating layers and the fluid oil impregnation), but this solution would involve obvious economic disadvantages because of the high expense involved in maintaining a rather large-scale conditioning plant which is capable of guaranteeing the required ambient characteristics.

However, even if it is assumed that adoption of this solution per se offered economic advantages, it must be noted that even under conditions of ambient humidity between 5% and 10% during the steps which precede the laying-up of the cores, high pressures of such magnitude may be generated between the insulating layers which will make any form of sliding between the layers practically impossible.

It follows that the operation of laying-up the cores (which includes a variation in curvature of each core with respect to the curvature imposed during the preceding collecting step) could be accompanied by the considerable risk of damaging the insulating layers (through the formation of creases and wrinkles) since these layers are impeded from sliding with respect to each other.

For obviating said damaging effects, an operation for pre-drying each core ought to be resorted to (immediately before the laying-up step), in order further to reduce the degree of humidity in the insulating layers. This operation would consequently reduce the pressures between the layers and allow for the desired degree of sliding to take place. Obviously, the addition of the pre-drying operation is per se another disadvantage.

One object of the present invention is to provide a new, improved process for manufacturing multi-core, submarine, power cables which obviates the disadvantages hereinbefore mentioned.

In the preferred process of the invention for manufacturing multi-core, submarine, power cables for conveying high-tension electrical energy, such cables being of the type wherein each conductor is provided with a central conduit for the flow of insulating fluid and wherein the insulation is composed of a series of tapes, impregnated with said insulating fluid and spirally wound around each conductor, comprises the steps of:

(i) making each conductor separately, for the entire required length;
(ii) applying the insulation on each conductor so as to form a core and arranging each core, without subjecting it to torsion, inside a rotatable tank;

(iii) evacuating and drying each core inside the tank and impregnating each core inside said tank with an insulating fluid;

(iv) extracting each treated core from said tank and applying around each core an individual, fluid impermeable, metallic sheath;

(v) applying around each of the cores provided with a metallic sheath, a reinforcement made from a blindage, applying a further sheath of plastic material and then collecting each reinforced core on an auxiliary platform which is rotatable on its own vertical axis;

(vi) lifting a reinforced core from each auxiliary platform, and laying-up a plurality of said cores together, without subjecting them to torsion, so as to form a multi-core cable; and (vii) applying around said cable a metallic armoring and covering the latter with a bituminous material.

The present invention also includes a multi-core, submarine cable manufactured according to said process.

According to a further preferred embodiment, said process includes the further step of applying a first screen of conducting material around each conductor, before the application of the insulation and, preferably, said process comprises the further step of applying a second screen of conducting material around each core after the application of the insulation.

With respect to the known processes for manufacturing multi-core, oil-filled, power cables, and with particular reference to the process described in said Italian patent which envisages applying a single metallic sheath around several cores, an initial advantage to be obtained, by employing the process of the present invention, which envisages applying an individual metallic sheath around each core, lies in substantially reducing the numer of "delicate" operations performed intermediate the application of the insulation around the conductor and the impregnation of the insulation. As a consequence, the absorption of ambient humidity into the insulating layers is reduced. Because of this, each core arrives at the drying step (preceding the impregnation step) in the best possible condition for rendering the subsequent operations both easier and more reliable.

It must be emphasized, moreover, that according to the process of the present invention, the laying-up step is accomplished after each core has been dried, impregnated with insulating fluid, and covered with a fluid impermeable, metallic sheath, and hence, the pressures, between the insulating layers, are substantially reduced, whereby the relative sliding between the layers is not impeded.

Thus, the translation, from the collecting step to the laying-up step, offers the further advantage of obviating any damaging risks to the insulating layers (through the formation of wrinkles and creases) and because of this, it becomes quite unnecessary to resort to the supplementary operation of pre-drying each core immediately before the laying-up step.

Another considerable advantage to be gained by adopting the process according to the present invention, is the fact that greater lengths of multi-core cables can thereby be obtained than when employed the known process described in said Italian patent.

As a matter of fact, said patent teaches that the impregnation of the layed-up cores takes place contemporaneously whereas, on the other hand, the process of the invention envisages that each core will be impregnated separately. Hence, depending on the actual dimensions of the impregnation tank, it can be made to hold a greater length of core as compared to the tank holding several layed-up cores together. The capacity of the collecting auxiliary platforms is practically the same (strictly speaking, being slightly greater in the known method) for both the processes.

Figure 2:
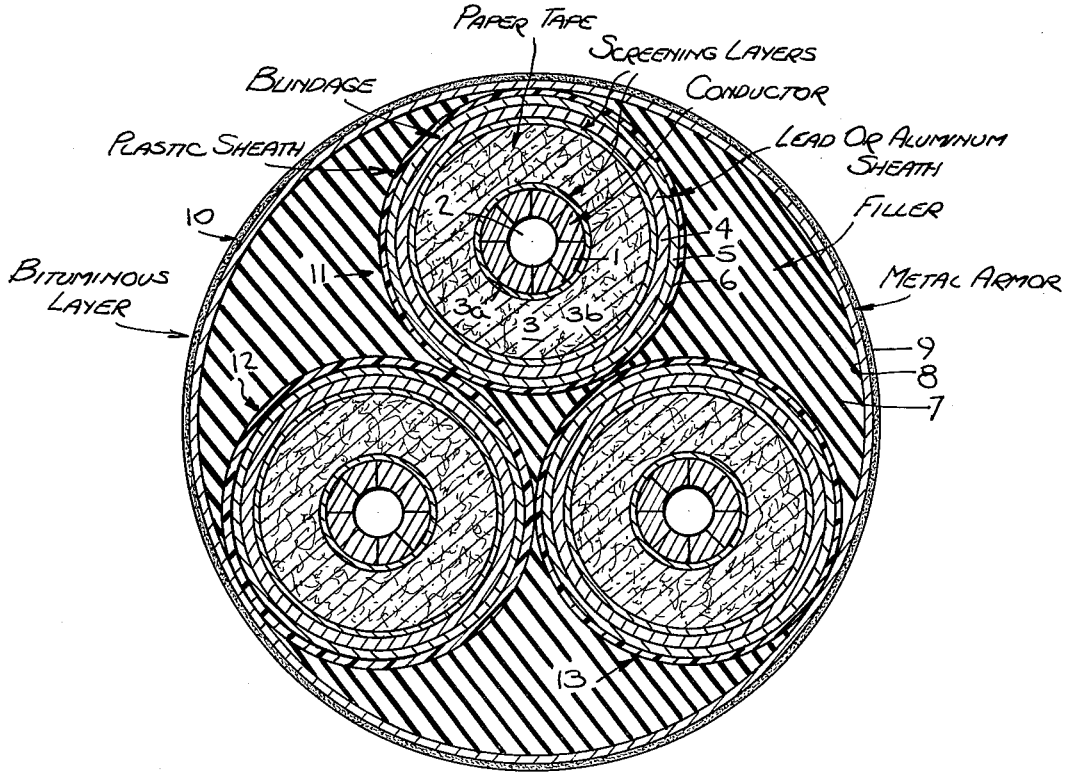

Other objects and advantages of the present invention will be apparent from the following detailed description of the presently preferred embodiments thereof, which description should be considered in conjunction with the accompanying drawings in which:

FIG. 1 is a flow diagram of the preferred process of the present invention, and relates to the manufacture of a three-core submarine cable; and FIG. 2 is a cross-sectional view of a three-core submarine cable, constructed according to the process of the present invention.

Referring first to FIG. 2, which illustrates a preferred form of a three-core, submarine cable 10 constructed in accordance with the process of the invention, the cable 10 comprises three identical core units 11, 12 and 13. Each of the core units 11–13 comprises a central conductor 1 of a known type having a central conduit 2 for the flow of insulating oil. Preferably, the conductor 1 is surrounded by a screening layer 3*a*, which may be a layer of a conducting or semi-conducting tape, e.g., a carbon paper tape. The layer 3*a* is surrounded by several layers 3 of paper tape of good insulating properties and, preferably, the layers 3 are surrounded by a second screening layer 3*b* similar to the layer 3*a*. Of course, as is obvious to those skilled in the art, the screening layers 3*a* and 3*b* may be omitted in some cases.

The layer 3*b* is surrounded by a metal sheath 4 which may be made of lead or aluminum, the latter preferably being corrugated. The sheath 4 is surrounded by a blindage layer 5, for example, a layer of metal tape to re-enforce the core with respect to radial pressures, and, in turn, the layer 5 is surrounded by a sheath 6 of a plastics material, such as polyethylene or polyvinyl chloride, to prevent water from reaching and damaging the sheath 4. The sheath 6 also aids in permitting the units 11–13 to move with respect to each other as they are layed-up, but if neither water protection nor such aid is desired, the sheath 6 is not necessary.

The three core units 11–13 are surrounded by an armoring layer 8 of a known type for mechanical and axial stress protection, and the spaces between the units 11–13 and between such units and the layer 8 may, if desired, be filled with a suitable filler 7, such as jute, rubber or a plastics material. Preferably, and particularly for submarine use, the armoring layer 8 is protected from corrosion by a layer 9 of bituminous material of a known type, but the layer 8 may be omitted or replaced by other known coverings depending on the conditions under which the cable 10 is to be used.

Referring now to FIGS. 1 and 2, the process according to the present invention begins by making the conductor 1 (step *a*), which, in special cases, is executed through the medium of a cabling machine, but which can also be accomplished by employing any other convenient apparatus, provided that a central conduit 2 is included for allowing for the flow of the insulating fluid. The conductor 1 is made for the entire required length and subsequently it is gathered up in coils without letting sharp folds or locally concentrated twisting forces to occur.

Once finished, the conductor 1 is lifted and is taken to a known lapping apparatus for applying the insulating layers 3 (step *b*) around it. This insulating layer may have different kinds of thicknesses, depending upon the characteristics which are required for the cable 10. For example, the insulating layers 3 may consist of a series of tightly lapped paper tapes, helically wound.

In order to obviate the absorption of ambient humidity between the paper-layers, it is a customary practice to accomplish the lapping operation in a conditioned ambient. The insulated conductor (which will be referred to hereinafter as the "core") is spirally wrapped in superimposed layers in a known type of impregnation tank, which is rotatable on its own vertical axis so as to prevent any twisting forces from occurring during the operation, which forces could cause damage to the conductor 1.

Once the placing of the core inside the impregnation tank has been completed, the tank is closed with its own appropriate cover, and an appropriate means is used for producing a hard vacuum and simultaneously producing heat inside the tank.

The core, enclosed inside the tank, is, in this way, vacuum dried. Once the desired condition of dryness is attained, a suitable insulating fluid is introduced into the tank for the purpose of impregnating the layers of the insulation, the fluid passing radially through the latter and filling up any empty voids and intersticial spaces between the tape turns (step c). As an insulating fluid, any product of either a synthetic origin (for example, alkylbenzene) or of a natural origin (for example, mineral oil) may be employed.

Once the impregnation treatment of the core has been completed, the rotatable tank is opened and the core, which is now amply coated with insulating fluid, is then extracted from the tank and transferred to a known type of extrusion press where a fluid impermeable, metallic sheath 4 (step d) is applied over the insulation layers 3. Said metallic sheath is generally made of lead or aluminum, preferably, corrugated aluminum in the latter case.

When extracting the core from the impregnation tank for transferring it to the press, attention must be given to prevent subjecting the core to torsion. This can be done by rotating the tank in the direction opposite to the direction used for placing the core inside the tank.

Air bubbles should be prevented from forming in the insulation while applying the sheath. This can be done by introducing the core in a known manner in a conduit provided with a previously primed syphon submerged under the fluid level of the tank. Said syphon, in straddling the edge of the tank itself, connects the tanks with the press, the metallic sheath being formed with an oil seal. Apparatus of this type is disclosed in U.S. Pat. No. 3,986,377.

Once the fluid impermeable, metallic sheath 4 has been applied to the entire length of the impregnated core, the process for accomplishing the steps connected with the actual electrical characteristics of the product may be said to have been fulfilled. What now remains to be carried out are those steps which concern, for the most part, the mechanical characteristics of the product itself (the protective covers or the re-enforcement).

Although not shown in FIG. 1, it must be remembered, nevertheless, that it might be necessary, in certain cases, to apply over the conductor 1 a first screen 3*a* of conductive material, for example, carbon paper, before applying the insulating layers 3. A second screen 3*b* of the same type can also be applied over the insulating layers 3 before the impregnating step. Moreover, other elements, depending on the desired characteristics of the final cable 10, may be added to the core as it is formed.

The impregnated core provided with the impermeable, metallic sheath 4 is next covered with a first reenforcement layer 5 (step e), which could consist of a blindage formed by metallic tapes for ensuring that the underneath metallic sheath 4 will have an adequate resistance against deformations in the radial direction, and is covered with a further sheath 6 of a plastics material, such as, for example, polyethylene or polyvinyl chloride.

As a result, a first unit 11 of three-core cable 10 is made up. It is then collected onto a first auxiliary platform A (step f) rotatable on its own vertical axis for preventing any torsion forces which could damage said unit 11.

Subsequently, two other cable units 12 and 13 are made up and collected onto the auxiliary platforms B and C, respectively, each platform being rotatable on its own vertical axis. The working operation of the auxiliary platforms A, B and C is explained in said Italian Patent No. 801,543.

Following this, a unit 11, 12 or 13 is lifted from each auxiliary platform A, B and C and the laying-up step is executed (avoiding torsion stresses on the unit) to construct a three-core cable unit (step g).

Eventually, but not necessarily, the empty voids and intersticial spaces which may exist between the three units 11–13 and between them and the armoring layer 8 of the cable may be filled with a suitable filler 7. It is not to be excluded, however, that other elements intended to satisfy the particular requirements of the three-core cable 10 may be wound around the three layed-up units 11–13.

Next, a metallic armoring layer 8 (step h) is applied to the three-core cable unit for the purpose of adequately strengthening the resistance of the cable, formed as described, against tensile stresses in the axial direction of the cable itself. Following this, preferably, a layer 9 of bituminous material is applied for protecting the underlying layers from corrosion of a chemical nature.

The finished cable 10 is then deposited in an appropriate storing area ready for use when required.

Although preferred embodiments of the present invention have been illustrated and described, it will be understood by those skilled in the art that various modifications may be made without departing from the principles of the invention.

What is claimed is:

1. A process for the manufacture of a long-length, multiple core unit, high tension, fluid filled electric cable, each core unit comprising a conductor having a fluid passageway, insulation around said conductor, a fluid impermeable sheath around said insulation and a mechanical re-enforcing layer around said sheath, and said cable comprising a plurality of said core units adjacent each other and surrounded by an armoring layer, said process comprising the steps of:

making a conductor of the desired long-length with a fluid passageway therein;

applying insulation around said conductor for the desired length thereof;

drying said insulation and impregnating it with an insulating fluid;

applying a fluid impermeable metal sheath around the so-impregnated insulation while protecting the insulated conductor with respect to air;

applying a mechanical re-enforcing layer around said metal sheath to thereby form a selfcontained core unit having the insulation thereof filled with said insulating fluid and protected with respect to air and moisture by said metal sheath;

repeating the preceding steps to form at least one additional said core unit;

laying-up the so-formed core units; and surrounding the layed-up core units with an armoring layer.

2. A process as set forth in claim 1 further comprising the step of surrounding said mechanical re-enforcing layer with a sheath of plastics material.

3. A process as set forth in claim 2 further comprising the step of surrounding said armoring layer with a corrosion resisting layer substantially impervious to water.

4. A process as set forth in claim 3, wherein said corrosion resisting layer is a coating of bituminous material.

5. A process as set forth in claim 1 further comprising applying a screen of conductive material around said conductor prior to applying insulation around said conductor.

6. A process as set forth in claim 1 further comprising applying a screen of conductive material around said insulation prior to applying said metal sheath around said insulation.

7. A process as set forth in claim 1 further comprising filling the spaces between said armoring layer and said core with a filler material.

8. A process as set forth in claim 1, wherein each core unit and said cable are formed with winding thereof without applying torsion stress thereto.

9. A process as set forth in claim 1, wherein three core units are formed and layed-up.

10. A process as set forth in claim 1, wherein said conductor with the insulation therearound is maintained in a bath of said insulating fluid after said insulation is impregnated and until said metal sheath is applied therearound.

11. A process for the manufacture of a long-length, multiple core unit, high tension, fluid filled electric cable, each core unit comprising a conductor having a fluid passageway, insulation around said conductor, a fluid impermeable sheath around said insulation and a mechanical re-enforcing layer around said sheath, and said cable comprising a plurality of said core units adjacent each other and surrounded by an armoring layer, said process comprising the steps of:

making a conductor of the desired long-length with a fluid passageway therein;

applying insulation around said conductor for the desired length thereof;

spirally wrapping the so insulated conductor in superimposed layers, without twisting of the insulated conductor, in a rotatable impregnation tank;

evacuating said tank, drying said insulation and then impregnating it with an insulating fluid;

removing the fluid impregnated, insulated conductor from said tank and extruding a fluid impermeable metal sheath around the so-impregnated insulation;

applying a mechanical re-enforcing layer around said metal sheath to thereby form a core unit;

repeating the preceding steps to form at least one additional said core unit;

coiling each core unit individually on a single rotatable platform;

laying-up the so-formed core units while avoiding torsion thereon; and surrounding the layed-up core units with an armoring layer.

12. A long-length, multiple core, fluid-filled, high tension electric cable comprising a plurality of core units, each core unit comprising a conductor having a fluid passageway therein, a layer of insulating fluid impregnated insulation around said conductor, a fluid impermeable metal sheath around said layer of insulation and a mechanical re-enforcing layer around said metal sheath, and said cable also comprising an armoring layer around said plurality of core units, said core units being in side-by-side relation within said armoring layer and being separately filled with said insulating fluid and said metal sheath preventing fluid flow from the inside to the outside of each core unit.

13. A cable as set forth in claim 12, wherein each of said core units further comprises a sheath of plastics material around said mechanical re-enforcing layer.

14. A cable as set forth in claim 13, wherein each of said core units comprises a screen of conductive material between said layer of insulation and at least one of said conductor and said metal sheath.

15. A cable as set forth in claim 13 further comprising a corrosion resisting layer substantially impervious to water around said armoring layer.

16. A cable as set forth in claim 12 further comprising a filler material intermediate at least portions of said core units and said armoring layer.

* * * * *